United States Patent [19]

Beamer

[11] Patent Number: 4,993,878

[45] Date of Patent: Feb. 19, 1991

[54] METHOD AND APPARATUS FOR FORMING A TRENCH

[75] Inventor: John V. Beamer, Atlanta, Ga.

[73] Assignee: Construction Casting Company, Atlanta, Ga.

[21] Appl. No.: 376,695

[22] Filed: Jul. 7, 1989

Related U.S. Application Data

[63] Continuation of Ser. No. 325,615, Mar. 17, 1989, which is a continuation-in-part of Ser. No. 103,678, Oct. 2, 1987.

[51] Int. Cl.[5] ..... E02B 5/00

[52] U.S. Cl. ..... 405/282; 249/10; 405/118

[58] Field of Search ..... 405/36, 118, 119, 282, 405/283; 249/1, 10, 11; 404/2, 3, 4

[56] References Cited

U.S. PATENT DOCUMENTS

| | | | |
|---|---|---|---|
| 786,305 | 4/1905 | McIntyre | 249/11 |
| 1,473,551 | 11/1923 | Gschwind . | |
| 1,562,780 | 11/1925 | Mickelson | 249/11 |
| 1,699,948 | 1/1929 | Biedermann . | |
| 1,722,038 | 7/1929 | Dougherty . | |
| 2,938,437 | 5/1960 | Daley | 404/4 |
| 3,212,267 | 10/1965 | Biehn | 61/15 |
| 3,299,785 | 1/1967 | James | 404/4 |
| 3,362,167 | 1/1968 | Ward | 405/282 |
| 3,568,455 | 12/1968 | McLaughlin et al. | 61/72.1 |
| 3,625,011 | 12/1971 | Stevenson | 405/36 |
| 3,797,188 | 3/1974 | Mansfeld | 52/396 |
| 4,258,897 | 3/1981 | Stees | 249/11 |
| 4,472,078 | 9/1984 | Karbstein | 404/2 |
| 4,787,773 | 5/1987 | Kehler | 405/118 |
| 4,844,655 | 7/1989 | Aleshire | 405/118 |

*Primary Examiner*—David H. Corbin
*Attorney, Agent, or Firm*—Needle & Rosenberg

[57] ABSTRACT

A device for forming a trench having a pair of frame members, connecting rods disposed between the frame members to maintain the frame members in a fixed position relative to each other, anchoring means attached to the frame members for positioning the frame members relative to the ground and a form removably held in a fixed position between the frame members having an upper surface and a shaped lower surface, the shaped lower surface providing means for molding a moldable trench composition into the shape.

48 Claims, 8 Drawing Sheets

FIG. 1
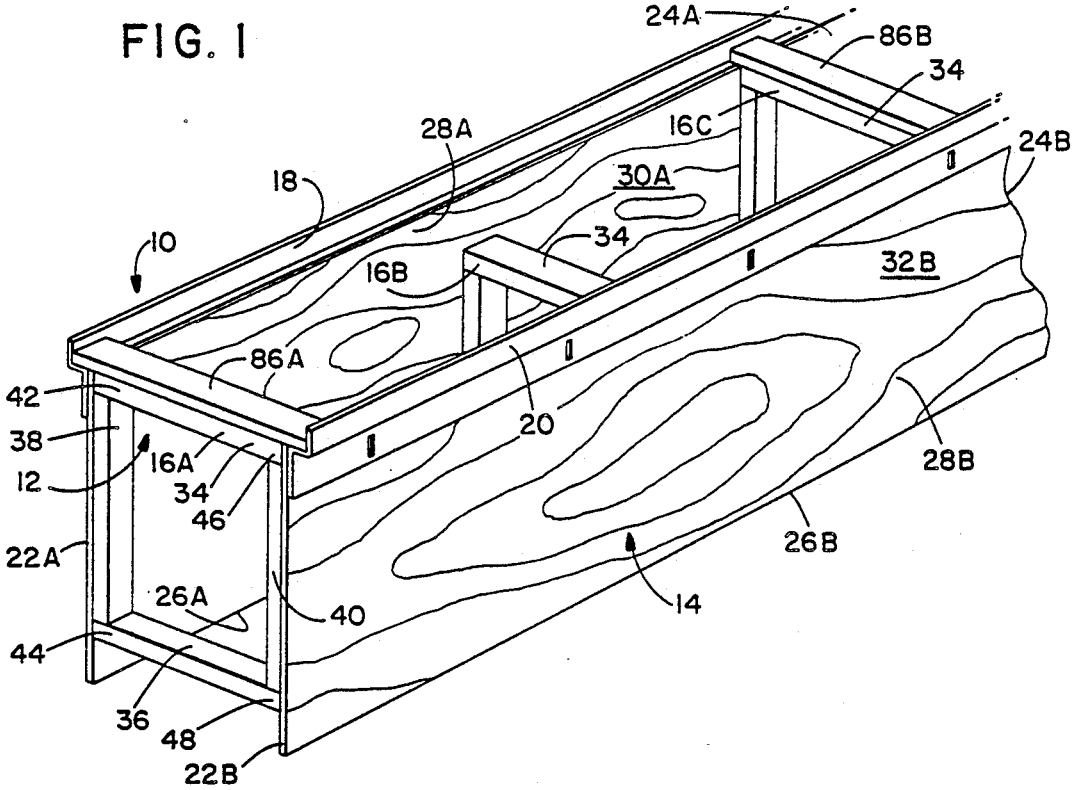
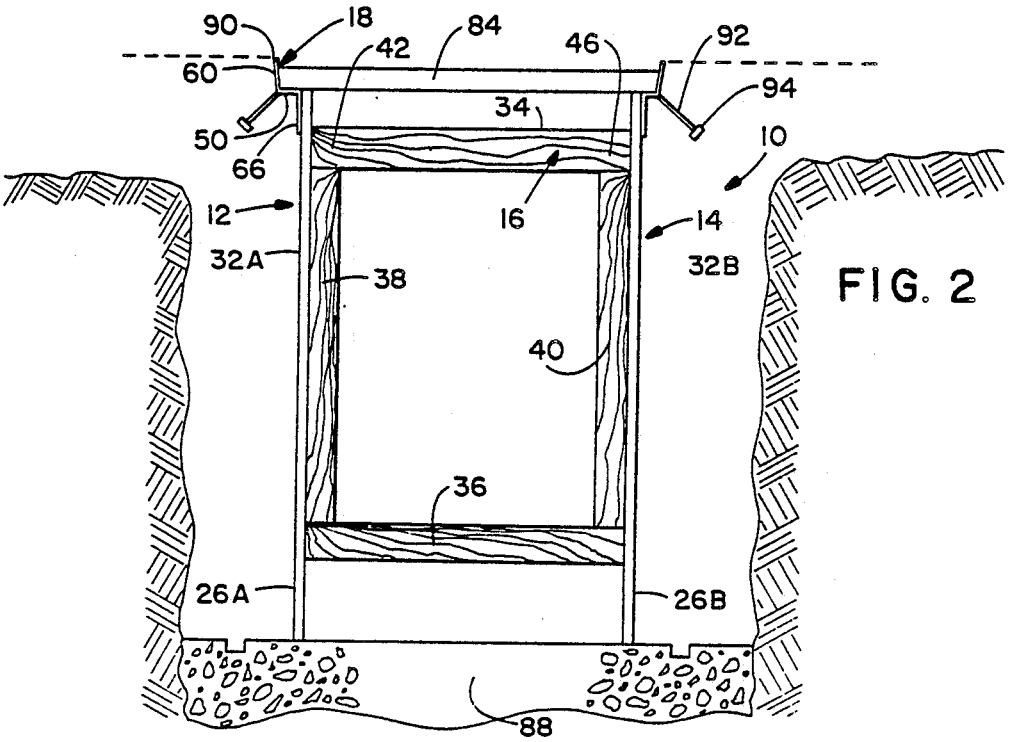
FIG. 2

METHOD AND APPARATUS FOR FORMING A TRENCH

BACKGROUND OF THE INVENTION

This is a continuation application of presently pending application Ser. No. 325,615 filed March 17, 1989, which was a continuation-in-part of Ser. No. 07/103,678 filed Oct. 2, 1987.

The present invention relates to the construction industry, and more specifically to the formation of a grate-covered trench including an assembly for forming the trench and a novel frame for the assembly.

The use of a concrete-lined, grate or solid covered trench, is well known in road, parking lot, and other constructions. The typical trench construction includes a pair of spaced frames, each having a grate supporting surface upon which a metal grate rests. Two major problems exist, however, that are directly related to the pair of spaced frames and the method of forming a grate-covered trench. Prior frame designs have created these problems. The design of prior frames have not made any provisions for direct attachment of the frames to the trench forms. The design of the prior frames has also not made any provisions for easy and accurate leveling of the frames once attached to the forms. The lack of these provisions being provided on prior frame designs, has added extreme expense to the projects requiring the installation of trench grates and frames. The preparation of the trench forms prior to the pouring of concrete is very time consuming because of the frame preparation that is necessary to attach the frames to the forms. Excess time is also consumed in the clumsy method of frame adjustment and leveling. The proper positioning of the frames, however, must be attended to and is of critical importance. If the grate supporting surface of the frames is not on a common lateral plane, grates may rock when cars or other heavy objects pass over the trench. Rocking grates may break or become dislodged completely from the frame causing a potentially serious hazard. Additionally, the vibration associated with rocking grates accelerates the spalling of concrete from under the frames.

The most common current method of forming a grate-covered trench begins with the preparation of a sloped concrete floor slab. Once the concrete has cured, a box-like form is placed inside the trench on the floor slab. The form typically has a pair of parallel plywood sidewalls, each corresponding to a trench wall, extending vertically from the floor of the trench to the final grade elevation. A number of spreaders, typically consisting of wooden joists, are fastened between the upper portion of the sidewalls for spacing the opposite sidewalls.

Also, inner bracing is used, consisting of wooden studs attached to the upper edge of a first sidewall at one end and to the lower edge of the second sidewall on the other. A criss-crossed pattern of bracing is achieved by altering the sidewall upper edge upon which the stud is attached.

The frame typically consists of an elongated bar having an L-shape when viewed cross-sectionally. A horizontal grate-supporting surface is provided, upon which an edge of the bottom of the grate rests, and a vertical back surface is provided for contacting the side edges of the grate. The frame has no means provided for direct attachment to or adjustment on the form.

Due to the fact that prior frames have no means provided for direct attachment to the form, a frame seat form, generally made of wood, must be made. The frame seat form has to be made with precise dimensions to match the frame back surface height and grate supporting surface width of the frame. It is necessary that the seat form have precise dimensions to ensure that solid contact is made between the seat form and along the entire length of the frame. Once the seat form is made, a hole must be drilled through the frame, if not provided, to allow the frame to be nailed to the seat form. The seat form is necessary to stabilize the frame position for attachment to the form sidewall. Should the seat form not image the frame, the frame will not lay flush when attached to the form side wall causing the frame to tilt inward or outward and be incorrectly positioned. Consequently, the seat form will have to be removed, re-worked and the frame re-nailed to the seat form. Frequently, the error in frame alignment is not realized until after the concrete is poured and the grates will not seat properly.

An inner joist is then typically placed along the upper edge of the inner surface of each sidewall opposite the seat forms. A hole is then drilled in the form sidewall at a point below the frame. The holes must be drilled at the proper location. Incorrect location of the wire holes will produce a frame not properly leveled. Determining the proper location of the hole to be drilled is difficult, due to the fact that the top of the trench form unit, when sitting on the sloped concrete-slab in the trench, is not at the same grade as the top of the trench. This makes it difficult to properly align the location where the wire holes need to be drilled. If the hole locations are incorrectly drilled, new holes will have to be drilled for proper leveling of the frame.

The frame with the nailed seat form is then to be attached to the upper portion of the outside surface of each form sidewall with the use of a 9 gauge or other heavy wire. The wire is placed through the drilled hole in the form sidewall and brought over the top of the frame sidewall and inner joist. The two ends of the wire are then intertwined, thereby tightening the frame into a position. At this point, should it be determined that the frames are not level or parallel, only minimal adjustment is permitted. The wire, frame and seat form have to be removed and the entire process started over.

It can be seen that this procedure is complicated and involves many steps requiring great attention to detail. Because prior frames cannot be directly attached to the trench form and because the frame-positioning means must be constantly adjusted, the construction of trenches using this method is time consuming and, therefore, expensive. Skilled personnel are required to properly position the frames on the trench forms. If this is incorrectly done, the procedure must be repeated from the start. Additionally, the need to be able to repeatedly maneuver the frame dictates that the frame be kept to a relatively short length (i.e., approximately two or three feet). Otherwise, the frame would be too heavy and difficult to handle when adjusting and repositioning the frame numerous times. The short length of the prior frames results in a large number of joints along the length of the trench between individual frame sections. The result is less optimal stability and additional time in positioning and leveling each frame.

Therefore, there exists a need for an improved method for producing a grate-covered trench.

There exists a need for an improved frame which attaches directly to the trench form and can be easily adjusted, thus simplifying installation and reducing the time required for forming the trench.

There exists a need for an improved frame which will give positive alignment and leveling in lieu of the prior trial and error methods.

There also exists a need for such a method of installation which is simple, relatively quick, and which does not require skilled labor.

There exists a further need for such a method which will allow the use of frames of relatively long length, thereby reducing the number of joints along the trench.

There exists a still further need for an improved frame which can be used in the above-mentioned methods.

SUMMARY OF THE INVENTION

The disadvantages of the prior art are overcome by the present invention which relates to a procedure for forming a grate-covered trench, as well as an apparatus used in such procedure.

A floor slab is poured along the bottom of an elongated trench. A trench form is built comprised of a pair of spaced, vertically oriented plywood sidewalls separated and held in relative stable, parallel position by a series of box-like bracings attached to the interior surfaces of both sidewalls. The bracings are preferably made from 2 x 4's, and their number is a function of the height and depth of the trench form, as well as the potential pressure exerted by concrete poured against the outside of the wall. It has been found that optimum stability can be achieved by varying the placement of the bracings lengthwise along the trench. That is, the bracings are alternated from a first position in which the upper surface of a bracing is flush with the upper edge of the plywood walls, and a second position in which the bracing is attached lower along the walls so as to give extra support to the bottom portion of the form.

A pair of adjustable frames for maintaining a grate in stable position along the trench are also provided. Each frame is preferably "Z"-shaped, in that it comprises a horizontally oriented rectangular grate support member, an upper grate contacting member extending vertically upward from the top, rear edge of the grate support member, and a sidewall contacting surface extending vertically downward from the bottom, forward edge of the grate support member. The sidewall contacting surface has a number of vertically extending adjustment slots.

To attach the frame to the form sidewall, the frame is positioned so that the frame sidewall contacting member is against the outside surface of the form sidewall, the forward edge of the grate supporting member being flush against the upper edge of the form sidewall. A hole is drilled through the form sidewall at a point corresponding to the location at the top of each adjustment slot. A bolt is placed through each hole and slot combination, preferably from the inside of the frame and a wing nut is placed at the open end of the bolt. The frame is thereby supported in position by the bolt. A second bolt is similarly attached to the opposite sidewall.

To obtain the desired level of grate orientation, the frame on one side of the trench must first be brought to the predetermined grade of the concrete which is to surround the trench. The frame is adjusted vertically as necessary by sliding the frame along the bolt through the slot. Upon achieving the desired position, the nut is tightened to the bolt. A workman then positions a grate or a flat piece of material the approximate length and width of a grate on the grate supporting members of the frames. The second frame is then adjusted to be in the same plane as the first. The degree of levelness is determined by the positive seating of the flat material resting on both frames. All nuts and bolts are tightened to firmly secure the frames against the form sidewalls, whereafter a spreader bar is placed between the frames to hold the frames at the correct width. Concrete can then be poured along the outside of the trench form to provide the finished product.

It can be seen, therefore, that the procedure, including its new frame design, can be used to quickly form a grate covered trench. The use of wire as a positioning means is eliminated, as is the large number of steps associated with such method. Also, because the method is simple, the need for skilled personnel is eliminated. Furthermore, the frames used in the present method, due to the unique leveling technique, can be of longer length than those presently in use. As a result, less joints appear in the final product, resulting in increased stability and greater load capacity. Additionally, spalling of the surrounding concrete is greatly reduced, further increasing stability and load capacity. Another important benefit of the technique of the present invention is that the use of longer frames acts to straighten the sidewalls, which in turn results in a more stable, and optimally leveled final product.

The present invention also relates to assemblies for forming grate-covered trenches. More particularly, it relates to forming such trenches with a single pouring of concrete.

A pair of adjustable frames for maintaining a grate in stable position along the trench are provided. Each frame is preferably "Z"-shaped, in that it comprises a horizontally oriented rectangular grate support member, an upper grate contacting member extending vertically upward from the top, rear edge of the grate support member, and a sidewall contacting surface extending vertically downwardly from the bottom, forward edge of the grate support member. The sidewall contacting surface has a number of vertically extending adjustment slots.

Each of the frames include adjustable anchoring means for adjusting the slope and height of the frames in relation to the ground and to each other. The anchoring means include a tubular collar which has an opening through which a supporting rod may pass. The anchoring means are firmly attached to the sidewall contacting surface of the frame. It is preferred that the anchoring means appear at each opposite end of the above-described frames, although additional such anchoring means may be provided in between the ends of relatively long frames. Each collar has a threaded bore through which a correspondingly threaded thumbscrew may be placed for securing the collar, and hence the frame, in position along the rod. Multiple bores and corresponding thumbscrews may also be placed in each collar to enhance securing the position of the collar along the rod.

A form pan is adjustably attached to the frames. Each frame is positioned so that the sidewall contacting member of the frame is against the outside surface of the form pan sidewall. In an alternate configuration, the sidewall containing member is against the inside surface of the form pan sidewall. The form pan includes, on each of its sidewalls, vertically extending adjustment slots correspondingly positioned to the adjustment slots of the frames. The slope of the form pan can be adjusted relative to the frames, as well as to the contour of the underlying ground, by placing a bolt through both the frame adjustment slot and the form pan adjustment slot and, once properly positioned, securing the frame and form pan together with a wing nut. This is repeated at second frame and form pan slots. As should be seen, the desired slope of the form pan can be accomplished by selectively positioning the points of securement along the respective slots. To assemble a trench, the frames and attached form pan are positioned within a ditch, and supporting rods are placed through the collar openings and firmly placed into the ground. The trench assembly may then be adjusted into position relative to the ground by adjusting the vertical positions of the collars along the rods, and maintaining these positions using the thumbscrews.

To form a relatively long trench, a plurality of the above-described assemblies may be joined end to end in a predug ditch, and their slopes, both relative to the ground and relative to the form pan, may be adjusted individually to provide an overall slope along the entire trench. Form pans of varying depths may be used to provide a continuous slope in very long trenches. A lap joint made of a firm material or tape may be provided at the point of abuttment of adjoining assemblies to join the assemblies tightly together and to prevent seepage of concrete upwards through the space between the assemblies.

Once the assembly or assemblies have been positioned and properly adjusted with spreaders in place, concrete is poured into the surrounding ditch. Once the concrete has set, the form pan, if desired, may be removed and the concrete will have formed a trench having a slope corresponding to that of the form pan. Alternatively, the form pan can be left in place. The anchoring means and supporting rods will be surrounded by the concrete, and the frames will be held firmly in place.

Also, the present trench assembly may be used without concrete. Rather, once positioned and adjusted, the ditch may simply be filled in with dirt and the form pan left to act as the required conduit.

The present invention also provides for forming a trench around a pre-shaped form. In this alternate embodiment, a pair of the above-described adjustable frames have disposed between them a connecting rod which is preferably held in place by welding. Typically, two or more such connecting rods are placed between each pair of frames to allow the frames to be held in a fixed position relative to each other. As described previously, each frame comprises adjustable anchoring means for adjusting the slope and height of the frames.

A removable pre-shaped form is held in a fixed position between the frames. The form is preferably made of expanded polystyrene, although other easily-shaped, removable materials may be used. The form has a flat upper surface and a shaped lower surface. The shape of the lower surface is constructed to approximate the shape of the desired trench. The form typically extends the length of the frames and the form upper surface is as wide as the connecting rods are long. Grooves are cut into the upper surface of the form in registration with the connecting rod so that the connecting rods may traverse the form below the form upper surface when the form is removably held in a fixed position between the frames. The ends of the form typically have wire retaining channels in them to allow lifting wires to be attached to the form at the ends. Lifting wires, which may be attached anywhere in the form, provide a way of easily removing the form from between the frames. The form may also have a lifting bar through it which aids in lifting the form from between the frames.

The form is typically fitted in between the pair of frames such that each groove fits over, and is adjacent to, each corresponding connecting rod. The trench form assembly, consisting of the pre-shaped form, frames, and above-described adjustable anchoring means, is positioned within a predug ditch and supporting rods are placed through the collars of the anchoring means and secured to the ground. The frames, and hence the form, are then adjusted into position relative to the planned finished surface by adjusting the vertical positions of the collars along the supporting rods and maintained in these positions with the thumbscrews. Once the trench form assembly is in place, concrete is poured outside the assembly so as to fill in the area around the supporting rods, frames, and the form. After the concrete is set the form is removed. Each connecting rod is typically first cut out from between the frames and the form lifted out. Alternatively, the connecting rods may be left in place and the form removed by breaking the form up into small pieces and removing the pieces separately from around each connecting rod or by pulling the form out from between the connecting rods when the form is made of a flexible material.

To form a relatively long trench, multiple trench form assemblies may be laid simultaneously and the end sections of each form placed adjacent to each other. Tape or lap joints may then be placed around the adjacent ends so as to prevent upward seepage of concrete when the concrete is being poured in the trench.

The final product will be a trench having the characteristics, including the slope, of the form.

It can be seen, therefore, that it is an object of the present invention to provide an improved method for producing a grate-covered trench.

It is also an object of the present invention to provide a method of installation which is simple, quick, and does not require skilled labor.

It is a further object of the present invention to provide such a method which allows the use of frames of relatively long length and "Z"-shape which results in a reduction of concrete spalling and number of frame joints.

It is also an object of the present invention to provide a frame which can be used in the above-mentioned methods.

It is an object of the present invention to provide a trench form which allows the formation of grate-covered trenches using only a single pouring of concrete.

It is also an object of the present invention to provide an assembly in which the user can independently adjust the slope of the frames relative to the ground and to each other and the slope of a form pan relative to the frames.

It is further an object of the present invention to provide a trench forming assembly in which a shaped form may be used to form a trench having the characteristics and slope of the shaped form.

BRIEF DESCRIPTION OF THE FIGURES OF THE DRAWINGS

FIG. 1 is a perspective view of a trench-form assembly of the present invention;

FIG. 2 is a cross-sectional view of a completed trench-form assembly of the present invention;

DETAILED DESCRIPTION OF THE PREFERRED EMBODIMENT

Figure 3:
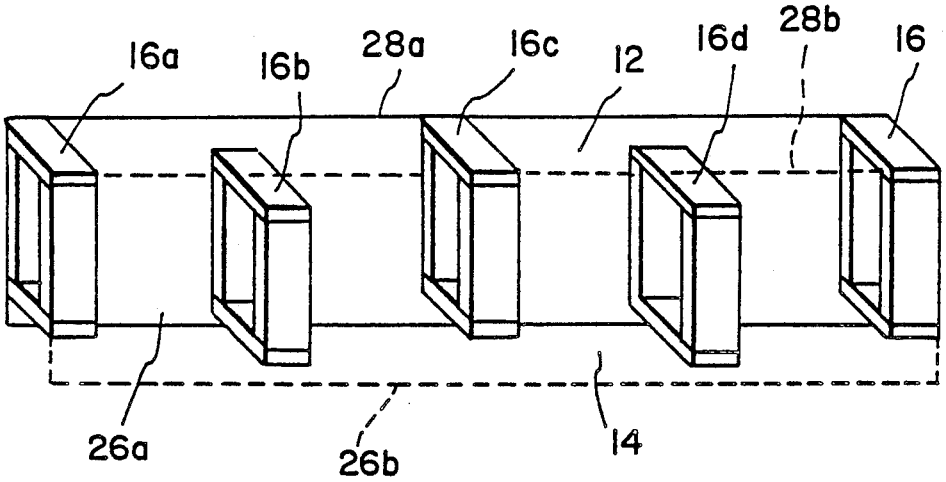
FIG. 3 is a perspective view of the bracings used in the trench-form assembly of the present invention with one sidewall shown in phantom lines.

Referring to FIGS. 1 and 2, a trench form assembly 10 is constructed for providing the initial framework of the grate-covered trench. The trench form 10 is comprised of a pair of parallel sidewalls 12, 14 maintained in spaced, vertical relationship by a number of box-like bracings 16*a, b, c.* A pair of frames 18, 20 for holding a grate in stable position are attached atop the sidewalls 12, 14. The term "grate," as used herein, refers to a standard industrial grate containing openings through which fluids may pass or a solid grate or covering having no openings therethrough.

Each sidewall 12, 14 is preferably a rectangularly shaped piece of three-quarter inch thick weather resistant plywood, having a forward side edge 22*a,b,* a rearward side edge 24*a,b,* a bottom edge 26*a,b,* a top edge 28*a,b,* an inner surface 30*a,b,* and an outer surface 32*a,b.* The bracings 16*a,b,c* are preferably made of wooden 2 x 4's, and are present to provide support to the assembly 10 when concrete is poured outside the sidewalls 12, 14. It should be noted that other moldable trench compositions may be used, although the examples herein refer to concrete. Each bracing 16*a,b,c* is comprised of an upper horizontal bracing member 34 of a length equal to the distance between the sidewalls 12, 14, a lower horizontal bracing member 36 of length equal to that of the upper bracing member 34 and first and second vertical bracing members 38, 40 equal in length to the desired distance between the upper and lower bracing members 34, 36, but preferably shorter than the height of the sidewalls 12, 14. The first vertical bracing member 38 is placed between and attached to a first end 42 of the upper bracing member 34 and a first end 42 of the lower bracing member 36 so as to form a first planar attachment surface. The second vertical bracing member 40 is placed between and attached to the end opposite the first end 46 of the upper bracing member 34 and the end 48 opposite the first end 44 of the lower bracing member 36 so as to form a second planar attachment surface. Nails or other fastening means may be used to hold the completed bracing 16 together.

As illustrated in FIG. 3, it is preferable that a number of bracings 16*a–e* be spaced between the sidewalls 12, 14. Attachment can be accomplished by nailing or other fastening means. It is also preferable that the vertical position of the attached bracings 16*a–e,* along the sidewalls 12, 14 be staggered so that the bracings 16*a–e* along the sidewall forward side edge 22 and rearward side edge 24 are flush with the sidewall top edges 28*a,b* and every second bracing 16*b,d* thereafter is attached lower along the walls 12, 14 to give extra support to the bottom of the form 10.

For example, it has been found that positioning the lower bracings 16*b,d* approximately three inches above the bottom edge 26*a,b* of the sidewalls 12, 14 will provide the proper support to the assembly 10. Such support at the lower region of the sidewalls 12, 14 is critical because that area is subjected to a greater amount of pressure than the upper region when concrete is poured around the assembly 10. If more than four bracings 16 are used in a single assembly 10, it is recommended that at least one inner bracing 16*c* also be positioned flush with the sidewall top edges 28*a,b.* The number of bracings 16 required per trench-form assembly 10 is a function of height, depth and potential concrete pressure along the outer surfaces 32*a,b* of the sidewalls 12, 14.

Once the bracings 16 are attached, the frames 18, 20 are connected to the sidewalls 12, 14. The frames 18, 20 serve as a supporting means for a grate placed over the trench. It is desired that the grate be supported as level as possible so as to not move when a vehicle crosses over it. To achieve such, the frames 18, 20 must be properly positioned.

Figure 4:
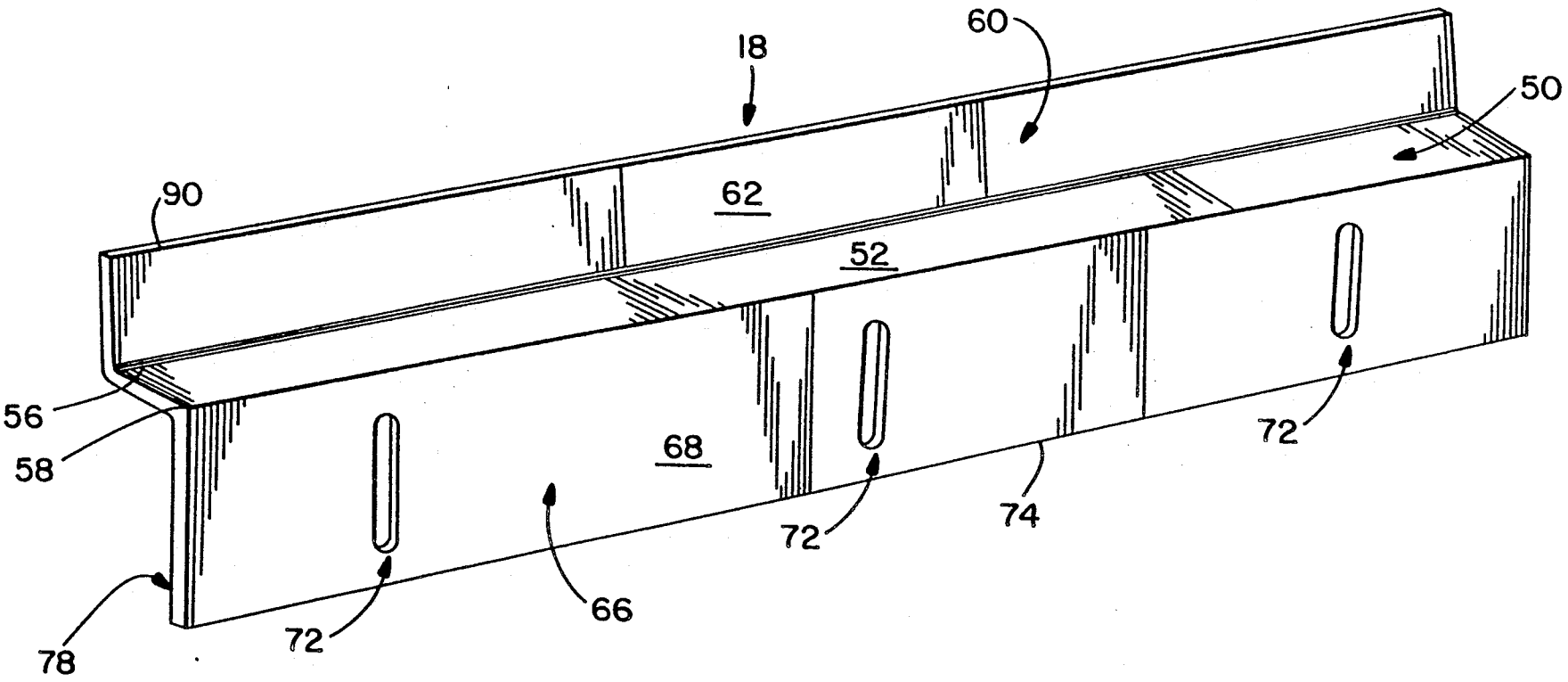
FIG. 4 is a perspective view of the frame of the present invention.
Figure 5:
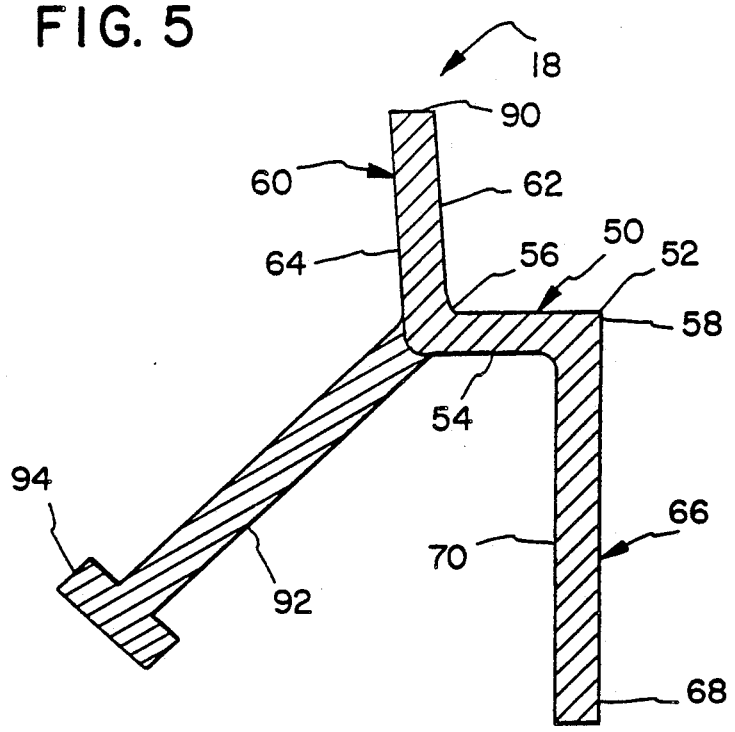
FIG. 5 is an end view of the frame of the present invention.

Each frame 18, 20 is made of a rigid material which preferably can be easily and inexpensively cast or extruded into the desired frame shape. The rigid material may also be a polymeric compound, such as plastic, which can be molded into the frame shape. The rigid material is preferably galvanized or painted steel, cast or extruded aluminum, or cast iron. Each frame 18, 20 is typically "Z"-shaped in cross section. Frame 18 as seen in FIGS. 4 and 5, has a rectangularly shaped and horizontally oriented grate supporting member 50, which has a planar top surface 52, a bottom surface 54 opposite the top surface 52, a rearward edge 56 and a forward edge 58 opposite the rearward edge 56. A rectangular upper grate contacting member 60 is also provided, extending vertically upward from the top surface 52 of the grate supporting member 50 along the supporting member's rearward edge 56, and having a front surface 62, a rear surface 64, and an upper edge 90. The upper grate contacting member 60 preferably runs along the entire length of the supporting member 50.

A sidewall contacting member 66 is also provided, extending vertically downward from the bottom surface 54 of the grate supporting member 50 forward edge 58, and having a front surface 68 and a rear surface 70. Preferably, the sidewall contacting member 66 also runs along the entire length of the supporting member 50. The sidewall contacting member 66 also contains a plurality of adjustment slots 72 extending approximately halfway up the member 66. Each slot 72 is preferably 5/16 inch in width and is closed at both ends. Each slot 72 may comprise an elongated or circular hole. The frame 20 is identical in construction to frame 18.

Figure 6:
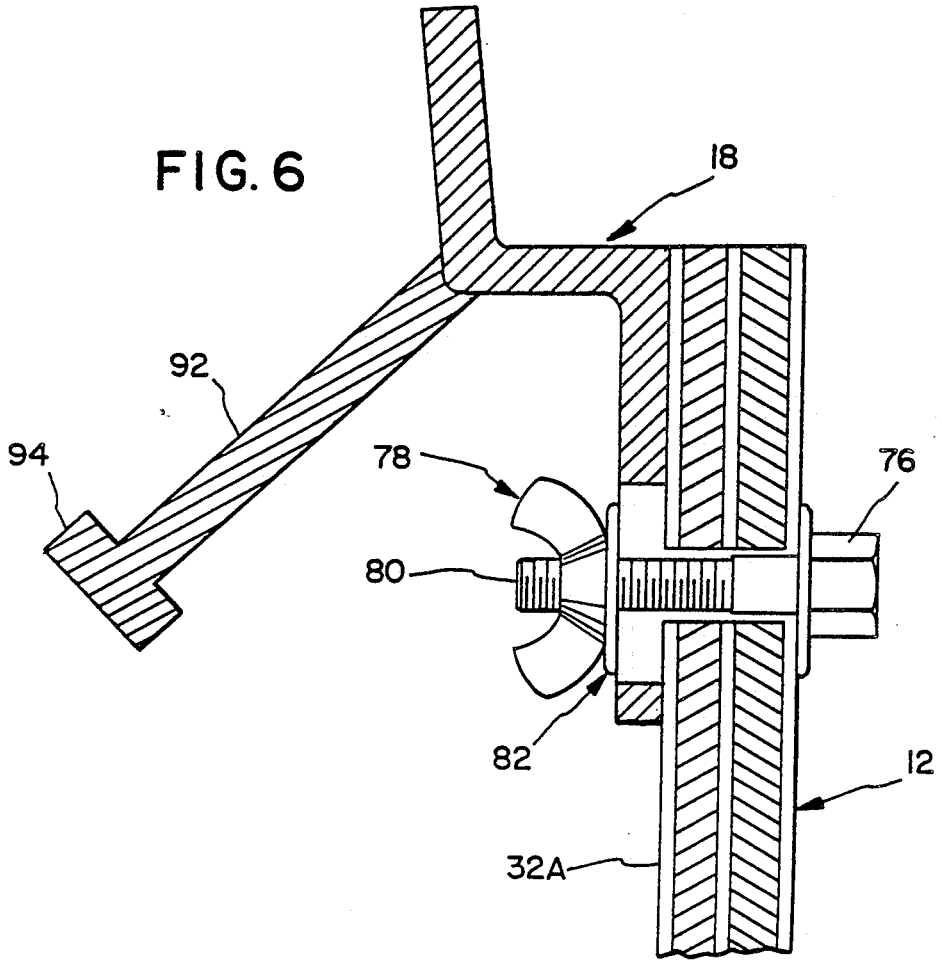
FIG. 6 is a cross-sectional view of the frame of the present invention as attached to the sidewall of a trench-form assembly.

To attach the frames 18, 20 to their respective sidewall 12, 14, the first frame 18 is positioned so that the front surface 68 of the sidewall contacting member 66 is against the outer surface 32*a* of the sidewall 12, and the top surface 52 of the grate supporting member 50 is flush with upper edge 28*a* of the sidewall 12. With a pencil or other indication means, each adjustment slot 72 is traced on the outer surface 32*a* of sidewall 12. A hole, preferably one-quarter to five-sixteenths inch in diameter, is then drilled at the top of each tracing. A bolt 76, as shown in FIG. 6, having a diameter slightly smaller than the width of the slot 72 is placed through each hole and adjustment slot 72 of the frame 18. A nut, preferably a wing nut 78, is placed on the open end 80 of each bolt 76. It is preferable that washers 82 be placed between the wing nut 78 and the rear surface 70 of the sidewall contacting member 66 for proper fastening. While the frame 18 is in desired position, the nut 78 on the endmost bolt 76 is firmly tightened. Next, the intermediate nuts 78 are tightened just enough to hold the frame 18 in place. After assuring that the frame 18 is still in proper anticipated position, the nut 78 on the remaining endmost bolt 76 is firmly tightened. Finally, the intermediate nuts 78 are firmly tightened to secure the frame 18 in place. Frame 20 is there after attached in similar fashion to the opposite sidewall 32*b*. It is noted that the frames 18, 20 may be attached to the sidewalls 12, 14 either before or after the bracings 16 are attached to the sidewalls 12, 14.

Once properly assembled, the trench-form assembly 10 is positioned within the trench dugout as shown in FIG. 2. It is preferable that a concrete floor slab 88 be prepared at the floor of the trench before the assembly 10 is positioned. It is commonplace, regardless of the procedure and frame-type used, to have to adjust the positions of the frames 18, 20 to achieve a properly set grate. To test for proper frame 18–20 positioning, a flat piece of material the length and width of a grate, or the grate 84 itself as shown in FIG. 2, is placed atop the frames 18, 20 in the desired anticipated position. Any deviation from proper position will result in rocking or other movement of the grate 84. To adjust the frames 18, 20 in the present invention, one simply loosens the nuts 78, repositions the frame 18, 20 vertically along the slots 72 until the grate 84 is properly set, and retighten. After leveling is completed, the flat piece of material or the grate is removed and spreader bars 86*a*, 86*b*, as shown in FIG. 1, are fastened to the top of all the upperly positioned bracings 16*a,c,d* to hold the frames 18, 20 at correct width, which is generally the width of the grate 84 plus three-sixteenth inches.

Once the assembly 10 is in place with the frames 18, 20 properly positioned on the sidewalls 12, 14, concrete is poured outside the assembly 10 so as to fill in the area between the assembly sidewalls 12, 14 and the trenchwalls. Also, concrete or other material may be laid over the surface of the ground surrounding the assembly 10 to a level corresponding with and contacting the upper edge 90 of the upper grate contacting member 60, as illustrated by the phantom lines in FIG. 2. The concrete acts, upon curing, to hold the assembly 10, and particularly the frames 18, 20, in a final position assuring a properly set grate 84. The grate 84 sits atop the planar top surface 52 of the grate supporting members 50 of the frames 18, 20, and is held securely between the upper grate contacting members 60 of frames 18, 20.

After the concrete is cured, the bolts 76 may be removed. The sidewall and bracing assembly 10 may be separated from the frames 18, 20. This allows the sidewall and bracing assembly 10 to be reused.

A further option is the use of an elongated stabilizing bolt 92 extending from the outer surface 64. Of the upper grate contacting member 60, bottom surface 54 or the point of intersection between the two members 50, 60. This bolt 92, as seen in FIG. 5, becomes surrounded by concrete after final construction of the trench and acts to provide additional stability to the frame 18, 20. The bolt 92 may have a head 94 located at its outer end to provide even further stability.

Figure 7:
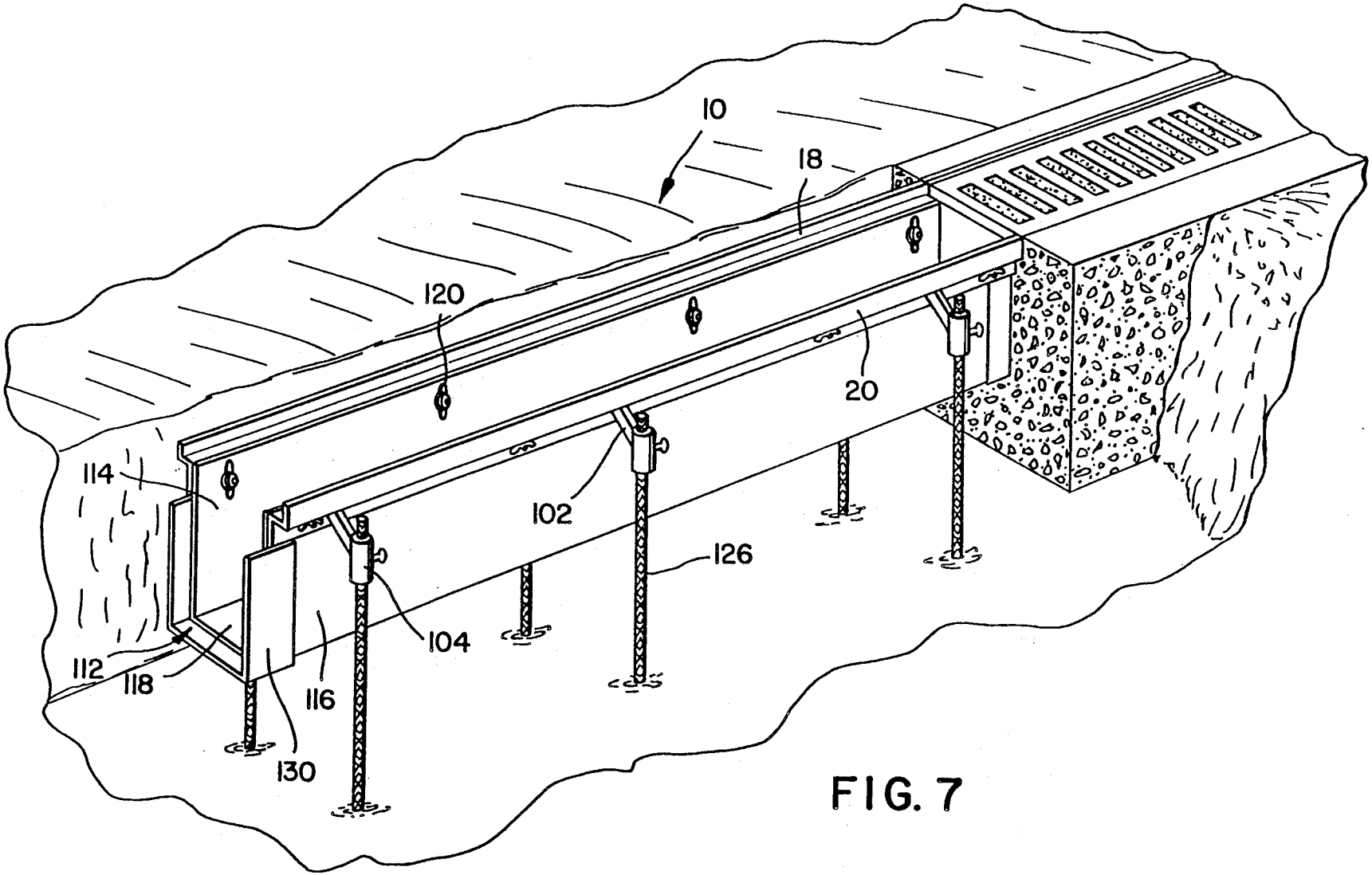
FIG. 7 is a perspective trench assembly having an adjustable form pan of the present invention.
Figure 8:
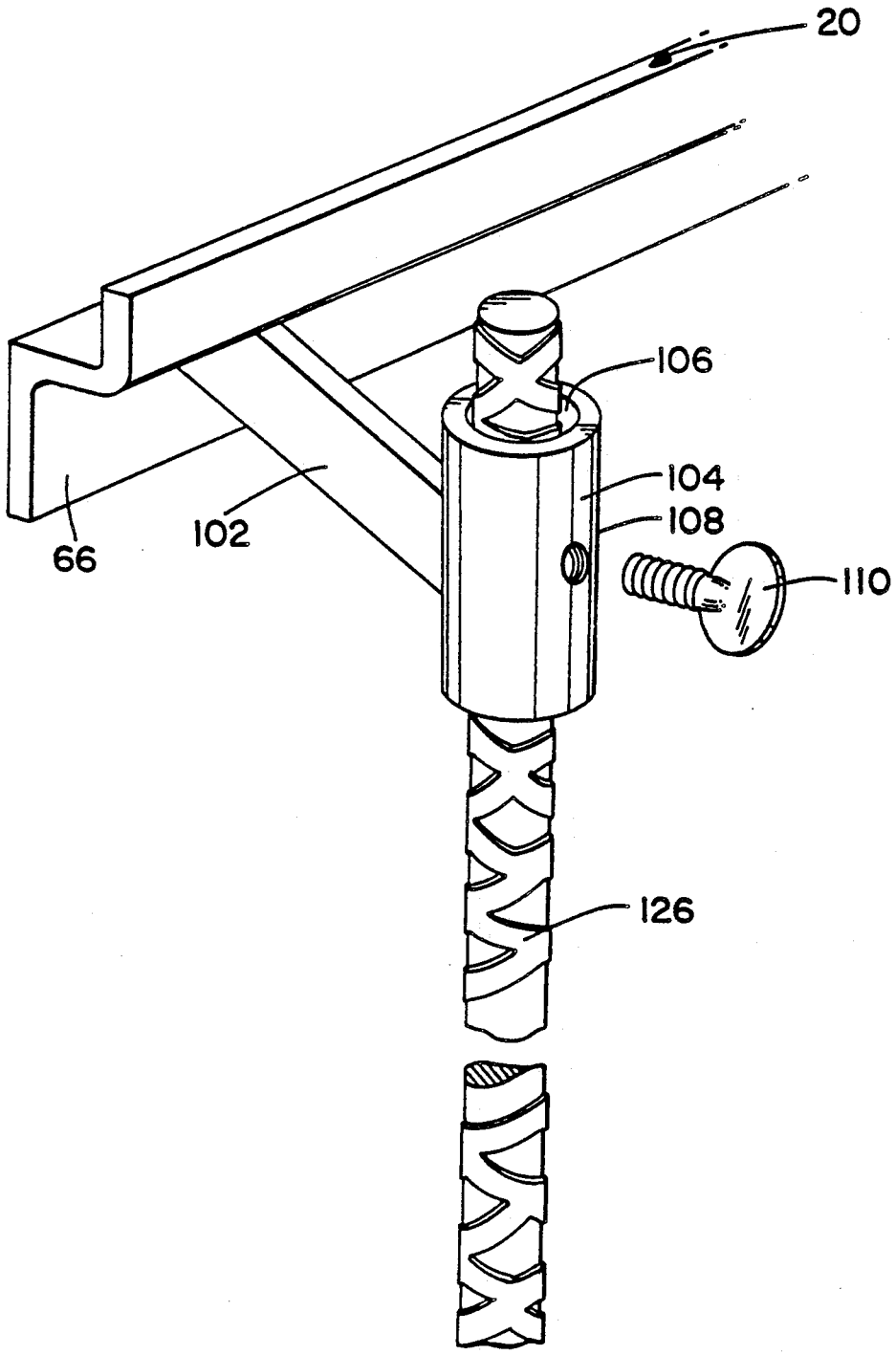
FIG. 8 is a partial perspective view of adjusting and anchoring means of the trench assembly of the present invention.

Referring to FIGS. 7 and 8, another embodiment of the present invention includes the above-described frames 18, 20, with the addition of a plurality of adjustable anchoring means. The anchoring means include an extending connecting member 102 attached at a first end to the bottom surface 54 of supporting member 50 of the frame 18 or 20 and to a collar 104 at the other end. Alternatively, the extending connecting member 102 may be attached at its first end to the rear surface 70 of the sidewall contacting member 66. The collar 104 has a vertical opening 106 through its length, as well as a single or plurality of threaded bores 108 in its sidewall. One or more thumbscrews 110 are provided threadingly corresponding with the bores 108. The collar 104 surrounds a support rod 126 which is anchored to the ground. The thumbscrews 110 are threadingly inserted into the bores 108 and may be tightened so as to maintain the position of the collar 104 on the supporting rod 126. It is preferred that the anchoring means appear at each opposite end of the above-described frames, although additional such means may be provided in between the ends of relatively long frames 18, 20.

Figure 11:
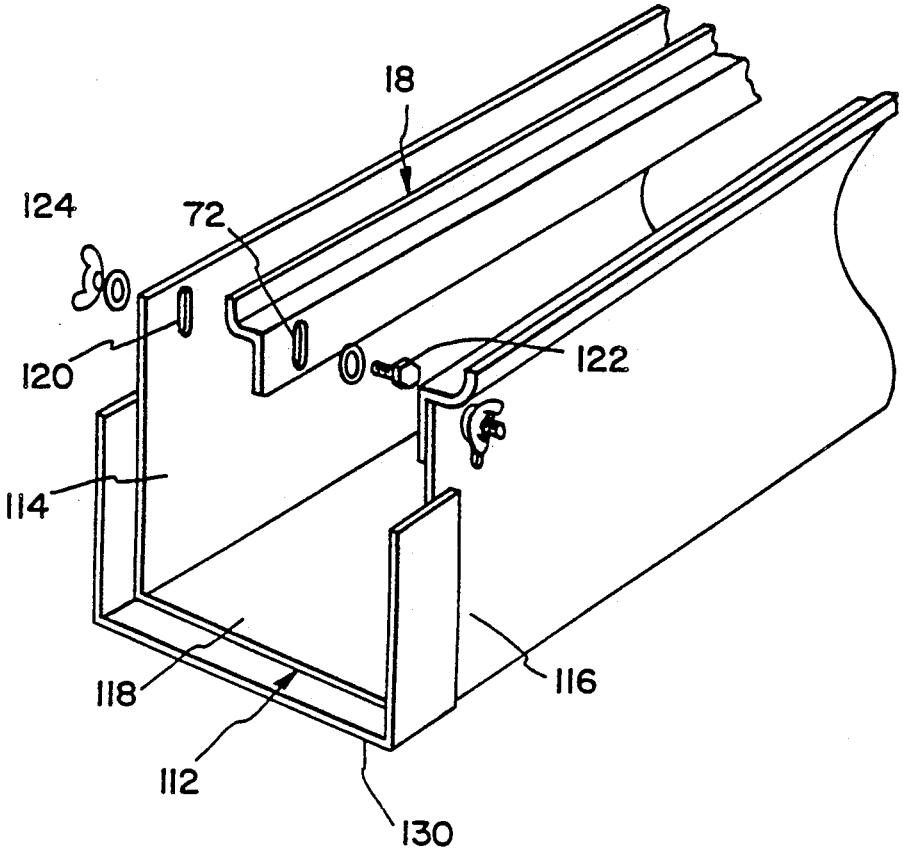
FIG. 11 is an exploded view of the means for adjusting the slope of the form pan of an alternate configuration of the trench assembly of the present invention.
Figure 10:
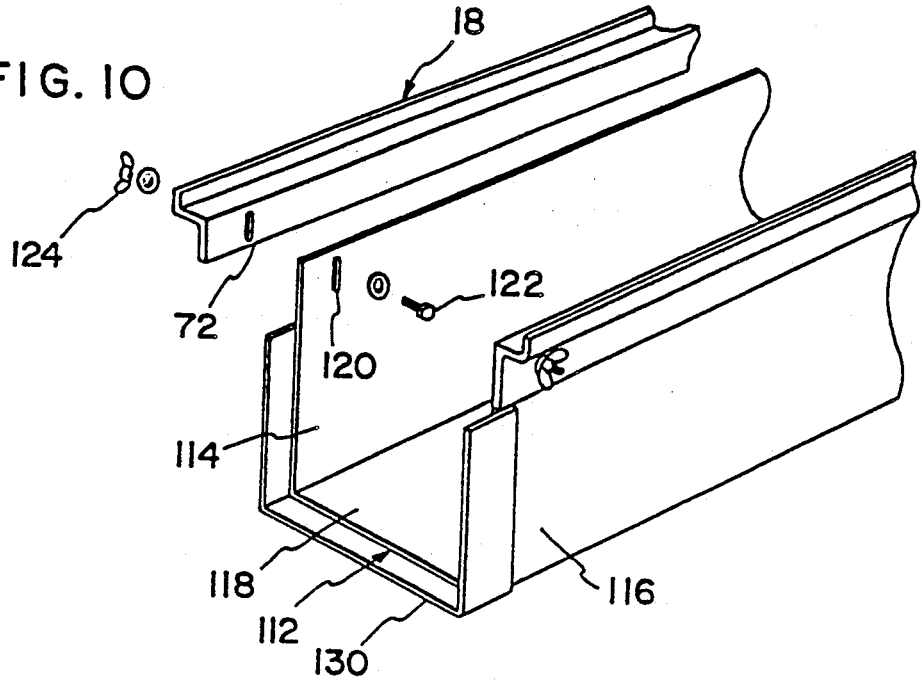
FIG. 10 is an exploded view of the means for adjusting the slope of the form pan of the trench assembly of the present invention.

An adjustable form pan 112 is provided as indicated in FIGS. 10 and 11. The form pan 112 may be comprised of steel, aluminum, plastic, or virtually any firm material. The form pan 112 has sidewalls 114, 116 and a bottom surface 118. Each sidewall 114, 116 has a plurality of vertically oriented adjustment slots 120 positionally corresponding to the adjustment slots 72 of the frames 18, 20. Each slot 120 is preferrably closed at both ends and may comprise an elongated or circular hole. By positionally corresponding, the sidewall slots 120 and frame slots 72 are aligned so that a bolt 122 may be placed through both a sidewall slot 120 and a frame slot 72 without interruption. The form pan 112 may be adjustably secured to the frames 18, 20 by placing a bolt 122, as seen in FIGS. 10 and 11, through both the frame slot 72 and form pan slot 120 and tightening with a nut 124. The frame slot 72 is preferably close-ended and may comprise an elongated or circular hole. For example, the frame slot 72 may be an elongated hole and the sidewall slot 120 may be a circular hole. The circular hole, when occupied by the bolt 122, would prevent any seepage of surrounding materials, i.e., wet concrete, into the form pan 112. A nut 124 and bolt 122 combination is typically placed at each frame slot 72 location in the frames 18, 20. The frame slot 72 and form pan slot 120 should be of sufficient width so as to allow the bolt 122 to easily be placed through the slots when aligning and securing the form pan 112 to the frames 18, 20. Each frame 18, 20 is typically positioned so that the frame sidewall contacting member 66 is against the outside surface of the form pan sidewall 114, 116 as shown in FIG. 10.

In an alternate configuration shown in FIG. 11, the frame sidewall contacting member 66 is against the inside surface of the form pan sidewall 114, 116. This configuration allows for an uninterrupted flow of fluid or material into the trench, as the protruding upper edges of the sidewall 114, 116 are protected from the flowing fluid or material by the sidewall contacting members 66. This alternate configuration prevents the collection of residual fluid or material on the sidewall upper edges and thus affords a trench that is easier to keep clean and free-flowing. This is particularly advantageous in environments such as the poultry processing industry, where the collection of residual biologic materials in a processing trench can result in bacterial overgrowth and unsanitary trench conditions.

To assemble a trench having the above-described form pan 112, a ditch is dug having a depth approximately 5" deeper than the depth of the desired final trench. The frames 18, 20 are loosely attached to the form-pan 112, and the frame and form pan assembly is placed into the ditch along the position in which the trench will be formed. If a relatively long trench is desired, a plurality of assemblies may be abutted to form a row. Once the assemblies are in place, supporting rods 126 are placed through the collar openings 106 and hammered firmly into the ground. The supporting rods 126 extend vertically above the collar 104 and should be driven in or cut off below the planned surface of the concrete.

The frames 18, 20 are positioned relative to the ground so that a grate may be placed on the frames 18, 20 without rocking or other unwanted movement, and the collars 104 are secured to their corresponding supporting rods 126 by means of tightening the thumbscrews 110. It is preferable that the diameters of the openings 106 be larger than the rods 126, so that a limited amount of movement of the frames 18, 20 in both a horizontal and vertical direction may be provided to enable adjustment of the frames 18, 20 to the desired height and slope by selectively positioning each collar 104. Once a proper positioning of the frames 18, 20 is obtained, their position may be maintained by securing the collars 104 to their corresponding support rods 126. Spacers may be placed between the frames 18, 20 to prevent further movement and hold them in stable position relative to each other. This procedure is repeated for all the frames 18, 20 along the length of the trench.

Once the frames 18, 20 have been positioned relative to the ground, the form pan 112 may be positioned relative to the frames 18, 20 so as to achieve the desired trench floor slope. This is accomplished by adjusting the position of the form pan 112 relative to the frames 18, 20 until the proper slope is obtained, and tightly securing them together with the bolts 122 and nuts 124. It should be seen that slope of the trench floor is afforded by independently moving each of the form pan slots 120 up or down around the bolts 122 prior to securing the frame 18, 20 and form pan 112 together. The bolts 122 and nuts 124 utilized should be selected to be of sufficient size to allow adequate movement of the form pan slot 120 around the bolts 122 so as to achieve the desired trench floor slope. This procedure is repeated for each assembly. If multiple frame and form pan assemblies are used, lap joints 130 or tape may be provided to join abutting ends of the form pans 112 to prevent seepage of concrete between the assemblies.

Once all the assemblies are properly adjusted (that is, all the frames 18, 20 are positioned relative to the ground and the form pans 112 positioned to provide the desired slope over the length of the trench), concrete is poured into the ditch so as to surround the trench assembly, and so as to cover the anchoring means and the majority of the length of each supporting rod 126. The supporting rods 126 aid in preventing the form pans 112 from floating upwardly in the wet concrete. Once the concrete firmly sets and the trench is formed, the form-pan 112 may, if desired, be removed from the frames 18, 20, which will be firmly secured in the concrete. Alternatively, the form pan 112 may be left in the trench. A grate may be placed on the frames 18, 20 to provide a covering for the formed trench.

Figure 9:
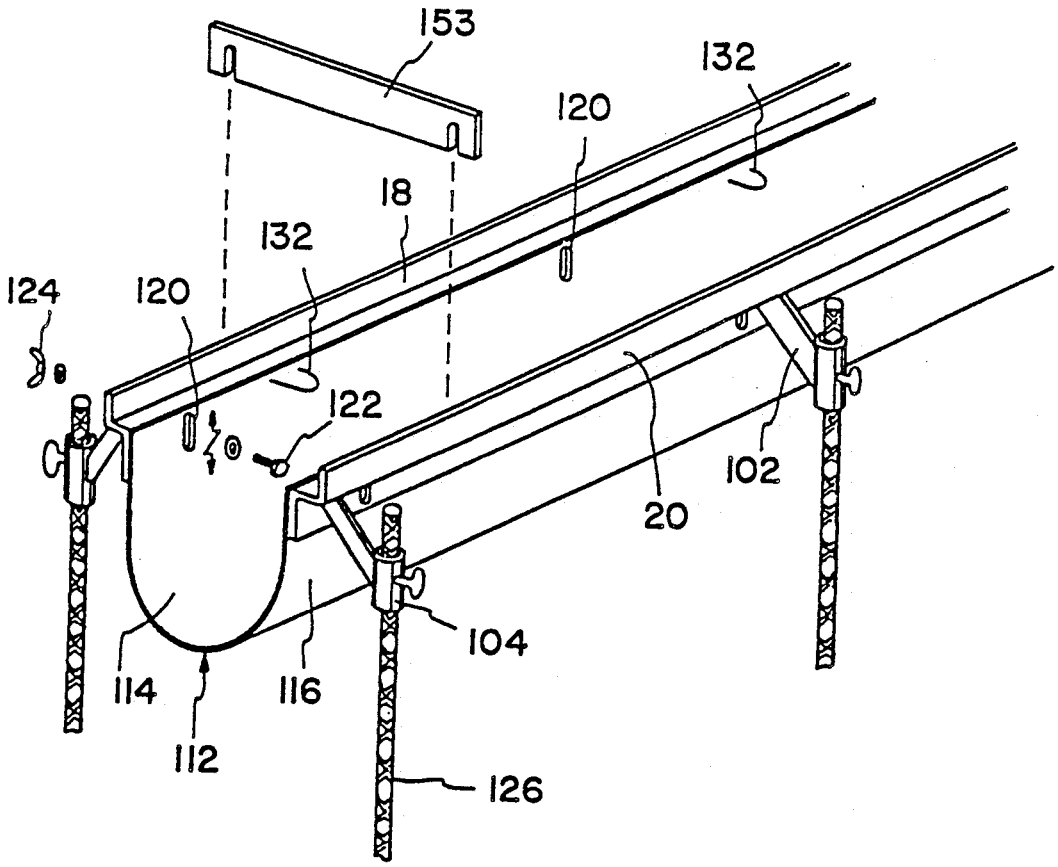
FIG. 9 is a partial perspective view of an alternative embodiment of the trench assembly of the present invention.

FIG. 9 shows a rounded form pan 112 having each frame 18, 20 positioned so that the frame sidewall contacting member 66 is against the outside surface of the form pan sidewall 114, 116. In an alternate configuration, the frame sidewall contacting member 66 is against the inside surface of the form pan sidewall 114, 116. Because of its tapering, the rounded form pan 112 will be relatively easy to remove from the concrete. A removable spacer 153 is placed between the frames 18, 20 to enhance stability and to maintain the desired distance between the frames 18, 20 when the rounded form pan 112 is surrounded by concrete. A plurality of spacers 153 may be utilized for each set of frames 18, 20. To further enhance removal of the form pan, lifting hooks 132 may be provided on the inside of sidewalls 114, 116 to provide lifting points. In addition, a releasing agent such as Crete-Lease 727 Releasing Agent manufactured by Cresset Chemical Company, Weston, Ohio may be applied to the outer surface of the sidewalls 114, 116 to facilitate form pan removal.

It should be seen that the adjustable form pan 112, as well as the adjustable anchoring means, enable the formation of a trench having varying slopes along its length. As such, trenches having customized slopes, such as to avoid rocks, pipes, etc., can easily be achieved. Varying fluid flow rates are also obtainable. Furthermore, the frames 18, 20 are secured into the ground via the anchoring means and not just into the concrete. Additionally, the concrete of the formed trench is also secured into the ground via the supporting rods 126. The device is inexpensive and easy to use, and, unlike precast forms, can be easily manufactured into a wide variety of widths and depths.

Figure 12:
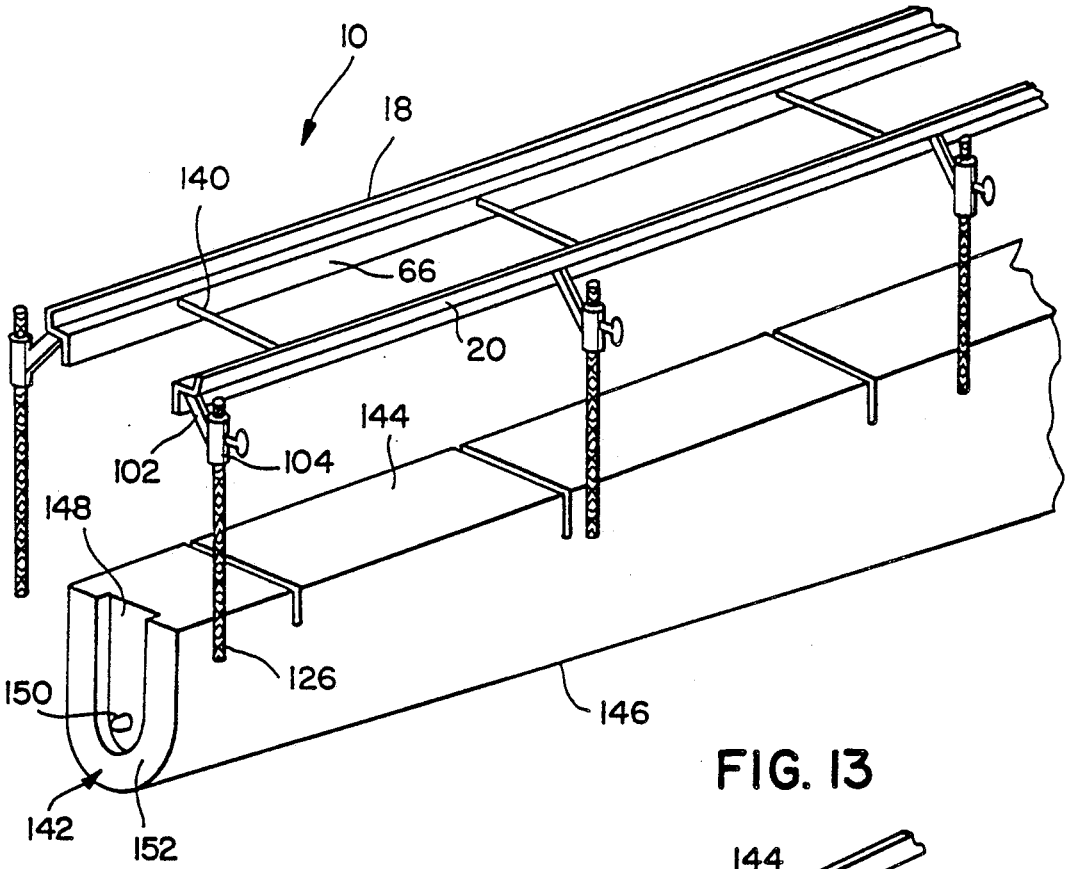
FIG. 12 is an exploded view of a trench-forming molding assembly of the present invention.
Figure 13:
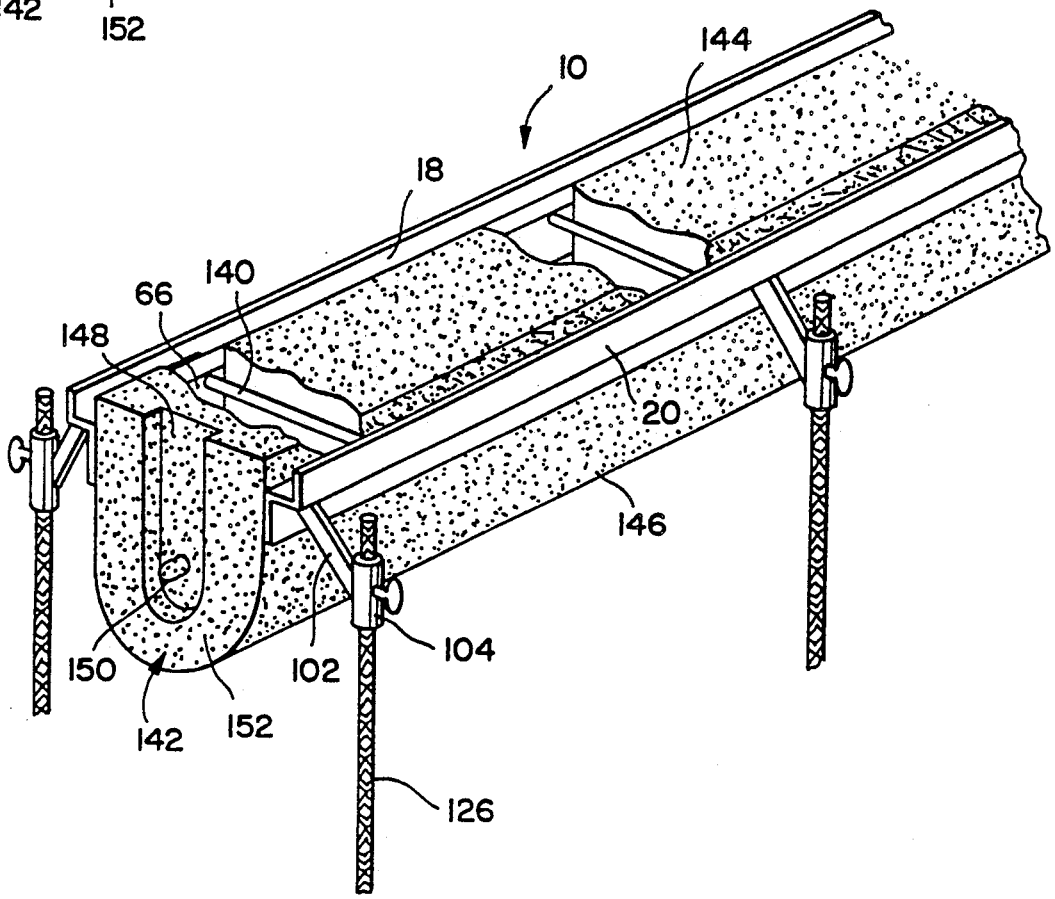
FIG. 13 is a partial perspective view of a trench-forming molding assembly of the present invention.

In a second alternate embodiment, as shown in FIGS. 12 and 13, a connecting rod 140 is disposed between the frames 18, 20. The connecting rod 140 is attached, preferably by welding, to the front surface 68 of sidewall contacting member 66 of each frame 18, 20. Typically two such connecting rods are placed between each set of frames 18, 20, i.e., one connecting rod 140 at each end of frames 18, 20, although more connecting rods 140 may be used. The connecting rods 140 allow the frames 18, 20 to be maintained in a fixed position relative to each other. As described above, each frame 18,20 comprises adjustable anchoring means for adjusting the slope and height of the frame 18, 20.

The trench form assembly also includes a form 142 removably held in a fixed position between the frames 18, 20. The form 142 is preferably made of expanded polystyrene, although other easily-shaped, removable materials may be used. The form 142 includes a flat upper surface 144 and a smooth, shaped lower surface 146. The lower surface 146 may be shaped to any contour desired, but it is preferred that it be tapered from the upper surface 144 to allow for easy removal from the final trench. The upper surface 144 of the form 142 is shaved or cut to adjust the slope of the lower surface 146 of the form when the upper surface 144 is in a level plane. The form 142 typically extends the length of its corresponding frames 18, 20, preferably about eight feet long, and the upper surface 144 is as wide as the connecting rods 140 are long. A groove is cut into the upper surface 144 of the form 142 in registration with each connecting rod 140 along the frames 18, 20. Each groove preferably should be the same depth to ensure that the proper slope of the lower surface 146 is maintained when the form 142 is held between the frames 18, 20 and its upper surface 144 is in a level plane. By being in registration with each connecting rod 140, the grooves will allow each connecting rod 140 to traverse the form 142 below the upper surface 144 when the form 142 is removably held in a fixed position between the frames 18, 20. Each end 152 of the form 142 typically has a wire retaining channel 148. Within this channel 148 is a lifting member 150, which protrudes perpendicularly to the wire retaining channels 148 on each end 152 and is secured to the form 142. A lifting wire is typically attached to the lifting member 150 and exits the wire retaining channel 148 at the upper surface 144 of the form 142. The lifting wire is used as an aid in removing the form 142 from between the frames 18, 20. Alternately, a lifting wire may be directly attached to the form 142 at a convenient point without using a lifting member 150 or wire retaining channel 148. The form 142 may also have a lifting bar placed longitudinally through it, having outer sections protruding at each end into the wire retaining channels 148. In this case, the outer bar sections may function as an attachment points for lifting wires. The shaped lower surface 146 of the form 142 may be coated with a releasing agent such as Crete-Lease 10 Release Agent manufactured by Cresset Chemical Company, Weston, Ohio. The releasing agent is used to provide easy removal of the form 142 from the final trench concrete.

Before the form 142 is fit into the frames 18, 20 and connecting rods 140, lifting wire is typically tied around each lifting member 150. The form 142 is then fitted in between the frames 18, 20 such that each groove fits over and is adjacent to each corresponding connecting rod 140. In this way, the form 142 is removably held in a fixed position between the frames 18, 20. The desired slope of the lower surface 146 is obtained when the connecting rods 140 are at the bottom of each groove. Once the form 142 is positioned between the frames 18, 20 and connecting rods 140, the trench form assembly is ready for positioning within a ditch.

The trench form assembly is positioned within a ditch by placing the support rods 126 through the collar openings 106 of collars 104 and hammering the rods 126 firmly into the ground. Once the rods 126 are secured in the ground by hammering, the frames 18, 20 are adjusted to the desired position relative to the ground and secured to the supporting rods by means of tightening the thumbscrews 110 threadingly inserted in the threaded bores 108 of the collars 104. In this way, the position of the frames 18, 20 is fixed. The supporting rods 126 may extend vertically above the collars 104 and typically are cut off below the planned surface of the concrete. Once the frames 18, 20, and hence the form, are in place, concrete is poured outside the assembly so as to fill in the area around the supporting rods 126, the frames 18, 20 and the form 142. After the initial concrete set is achieved, the form 142 is removed and a trench having the shape and slope of the removable form 142 is left behind. In this way, the form 142 provides means for molding a moldable trench composition (i.e., concrete) into a desired shape. To remove the form 142, each connecting rod 140 should first be cut out from between the frames 18, 20. Then, using the lifting wires, each form 142 can be lifted from between the frames.

Alternatively, each connecting rod 140 may be left in place to further stabilize the frames and the form 142 removed with the rods 140 in place. This may be accomplished by various methods such as selectively destroying the form 142, i.e., breaking the form up into small pieces and removing the pieces separately from around each connecting rod 140, or by pulling or extracting the form 142 between the rods 140 and frames 18, 20 when the form 142 is made of a flexible material.

Also, multiple trench form assemblies may be laid simultaneously. In this case, the end sections of each form should be placed adjacent to each other and tape should be placed around their abutting ends. The tape will prevent upward seepage of concrete when the concrete is being poured into the trench. Alternatively, a lap joint may be placed around the abutting ends of the adjacent forms to prevent the upward seepage of the concrete. A trench having varying slopes can be created by varying the characteristics of each of the forms.

The final product utilizing the second alternate embodiment of the present invention will be a trench having the characteristics, including the slope, of the form. The connecting rods serve to prevent the form from floating in the wet concrete, and thereby a great amount of accuracy can be obtained regarding slope characteristics. Should there be any tendency of the form to further float, additional weight, such as cement blocks, may be placed on top of the form to hold the form in proper position. After the final concrete set has occurred, a grate may be placed on the frames 18, 20 to provide a covering for the formed trench.

Although several embodiments of the invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope of the invention.

What is claimed is:

1. A device for forming a trench comprising:

(a) a pair of frame members;

(b) a connecting rod disposed between said frame members to maintain said frame members in a fixed position relative to each other;

(c) anchoring means attached to said frame members for positioning said frame members relative to the ground; and (d) a form removably held in a fixed position between said frame members and having an upper surface and a shaped lower surface, said shaped lower surface providing means for molding a moldable trench composition into the shape of the lower surface.

2. The device of claim 1, wherein said anchoring means comprise:

(a) a supporting rod capable of being securely anchored to the ground;

(b) a collar attached to said frame member having a vertical opening through its length and capable of being positioned over and securely attached to said supporting rod; and (c) means for maintaining the position of said collar on said supporting rod.

3. The device of claim 2, wherein said vertical opening has a diameter greater than the diameter of said supporting rod to allow for positioning said frames relative to the ground.

4. The device of claim 2, wherein said collar is attached to said frame member by means of a connecting member.

5. The device of claim 4, wherein said connecting member is a horizontally extending connecting member.

6. The device of claim 2, wherein said collar has a threaded bore into which a thumbscrew may be threadingly inserted so as to provide said means for maintaining the position of said collar on said supporting rod when said thumbscrew is tightened.

7. The device of claim 2, wherein said collar has a plurality of threaded bores into which thumbscrews may be threadingly inserted so as to provide said means for maintaining the position of said collar on said supporting rod when said thumbscrews are tightened.

8. The device of claim 1, wherein said upper surface of said form has a groove in registration with said connecting rod for removably holding said form in a fixed position between said frame members.

9. The device of claim 1, wherein said form has a wire having a first end securely attached to said form and a second end opposite said first end extending above said form so as to provide means for lifting said form from between said frames.

10. The device of claim 1, wherein said form has a pair of side ends, said side ends perpendicular to the longitudinal axis of said form.

11. The device of claim 10, wherein said form has a pair of channels, each said channel in a side end of said form, and further comprising means for removing said form from between said frames provided in said channels.

12. The device of claim 11, wherein said means for removing said form from between said frames comprise a pair of wires, said first wire having a first end securely attached to said form in said first channel and a second end opposite said first end extending above said form, said second wire having a first end securely attached to said form in said second channel and a second end opposite said first end extending above said form.

13. The device of claim 11, wherein said form has a pair of lifting members protruding perpendicular to the transverse axis of said form, said first lifting member contained in said first channel, said second lifting member contained in said second channel, said first lifting member having a first end attached to said form and a second end opposite said first end, said second lifting member having a first end attached to said form and a second end opposite said first end.

14. The device of claim 13, wherein said means for removing said form from between said frames comprise a pair of wires, said first wire having a first end securely attached to said second end of said first lifting member and a second end opposite said first end extending above said form, said second wire having a first end securely attached to said second end of said second lifting member and a second end opposite said first end extending above said from.

15. The device of claim 11, and further comprising a lifting bar placed longitudinally through said form, said lifting bar having a pair of outer sections protruding perpendicularly to the transverse axis of said form, said first outer section contained in said first channel, said second outer section contained in said second channel.

16. The device of claim 15, wherein said means for removing said form from between said frames comprises a pair of wires said first wire having a first end securely attached to said first outer section and a second end opposite said first end extending above said form, said second wire having a first end securely attached to said second outer section and a second end opposite said first end extending above said form.

17. The device of claim 1, wherein said frame members are capable of supporting a grate and each comprise:

(a) a horizontal grate supporting member comprising:
  (i) a generally planar top surface upon which the bottom of a grate may rest;
  (ii) a bottom surface opposite said top surface;
  (iii) a rearward edge; and
  (iv) a forward edge opposite said rearward edge;

(b) an upper grate contacting member extending vertically upward from said top surface of said grate supporting member at said rearward edge of said grate supporting member for contacting a side of said grate; and (c) a form contacting member extending vertically downward from said bottom surface of said grate supporting member at said forward edge of said grate supporting member having a front surface and a rear surface, said rear surface opposite said front surface; said front surface for contacting said removable form; said first frame contacting said form so that the forward edge of its grate supporting member faces said second frame front surface and said second frame contacting said form so that the forward edge of its grate supporting member faces said first frame front surface so that said grate supporting members form a surface upon which said grate rest; said connecting rod attached at a first end to said first frame front surface and at a second end opposite said first end to said second frame front surface.

18. The device of claim 1, wherein said form lower surface is coated with a releasing agent.

19. The device of claim 1, wherein said form is made of expanded polystyrene.

20. The device of claim 1, wherein said frame members are made of steel.

21. The device of claim 1, wherein said frame members are made of cast iron.

22. The device of claim 1, wherein said frame members are made of aluminum.

23. The device of claim 1, wherein said frame members are made of a polymeric compound.

24. The device of claim 1, wherein said connecting rod is capable of being removed from between said frame members.

25. The device of claim 1, wherein said moldable trench composition is cement.

26. A system for forming a trench, comprising a plurality of adjacent trench forming devices, each said device comprising:

(a) a pair of frame members;

(b) a connecting rod disposed between said frame members in a fixed position relative to each other;

(c) anchoring means attached to said frame members for positioning said frame members relative to the ground and to the adjacent devices; and (d) a form removably held in a fixed position between said frame members and having an upper surface and a shaped lower surface, said shaped lower surface providing means for molding a moldable trench composition into the shape of the lower surface.

27. The system of claim 26, wherein each said device has a front end and a back end opposite said front end, said front end and said back end perpendicular to the longitudinal axis of said device, said front end of a first device abutting against said back end of an adjacent device when said devices are placed adjacent to each other.

28. The system of claim 26, wherein said forms of said trench forming devices are placed adjacent to each other.

29. The system of claim 28, wherein each said form of each said device has a front end and a back end opposite said front end, said front end and said back end perpendicular to the longitudinal axis of said form, said front end of a first form abutting against said back end of an adjacent form when said forms are placed adjacent to each other.

30. The system of claim 29, and further comprising means for preventing said moldable trench composition from seeping between said abutting forms.

31. The system of claim 30, wherein said preventing means comprise adhesive tape attached to said shaped lower surfaces of said adjacent forms.

32. The system of claim 30, wherein said preventing means comprise a lap joint attached to said shaped lower surfaces of said adjacent forms.

33. A method of forming a trench from a moldable trench composition comprising:

(a) forming a ditch in the ground;

(b) placing a trench device in the ditch, said device comprising:

(i) a pair of frame members;

(ii) a connecting rod disposed between said frame members to maintain said frame members in a fixed position relative to each other;

(iii) anchoring means attached to said frame members for positioning said frame members relative to the ground; and (iv) a form removably held in a fixed position between said frame members and having an upper surface and a shaped lower surface, said shaped lower surface providing means for molding a moldable trench composition into the shape of the lower surface, (c) positioning said frame members relative to the ground;

(d) placing a moldable trench composition in the ditch and around said trench forming device to form a trench having the shape and slope of said trench forming device form; and (e) removing said form from between said frame members after said moldable trench composition has set.

34. The method of claim 33, and further comprising the step of removing said connecting rod from between said frame members after said moldable trench composition has set.

35. The method of claim 33, wherein said anchoring means comprise:

(a) a supporting rod capable of being securely anchored to the ground, (b) a collar attached to said frame member having a vertical opening through its length and capable of being positioned over and securely attached to said supporting rod, and (c) means for maintaining the position of said collar on said supporting rod; and the positioning step comprises anchoring said supporting rod to the ground and securely attaching said collar to said supporting rod to fix the position of said frame members relative to the ground.

36. The method of claim 33, and further comprising the step of coating said form lower surface with a releasing agent before placing said trench forming device in the ditch.

37. The method of claim 33, and further comprising the step of placing a grate on said frame members after said moldable trench composition has set.

38. The method of claim 33, and further comprising the step of placing additional weight on top of said form while said moldable trench composition is setting.

39. A method of forming a trench form from a moldable trench composition comprising:

(a) forming a ditch in the ground;

(b) placing a plurality of adjacent trench forming devices in the ditch and adjacent to each other, each said device comprising:

(i) a pair of frame members;

(ii) a connecting rod disposed between said frame members to maintain said frame members in a fixed position relative to each other;

(iii) anchoring means attached to said frame members for positioning said frame members relative to the ground; and (iv) a form removably held in a fixed position between said frame members and having an upper surface and a shaped lower surface, said shaped lower surface providing means for molding a moldable trench composition into the shape of the lower surface.

(c) positioning said frame members of each said device relative to the ground and to the adjacent devices;

(d) placing a moldable trench composition in the ditch and around said plurality of trench forming devices to form a trench having the shape and slope of said plurality of said trench forming device forms; and (e) removing said form of each said device from between said frame members of each said device after said moldable trench composition has set.

40. The method of claim 39, and further comprising the step of removing said connecting rod of each said device from between said frame members of each said device after said moldable trench composition has set.

41. The method of claim 39, wherein said anchoring means of each said device comprise:

(a) a supporting rod capable of being securely anchored to said ground, (b) a collar attached to said frame member having a vertical opening through its length and capable of being positioned over and securely attached to said supporting rod, and (c) means for maintaining the position of said collar on said supporting rod; and said positioning step comprises anchoring said supporting rod of each said device to the ground and securely attaching said collar of each said device to said supporting rod of each said device to fix the position of said frame members of each said device relative to the ground and to the remaining devices.

42. The method of claim 39, and further comprising the step of coating said form lower surface of each said device with a releasing agent before placing said plurality of trench forming devices in the ditch.

43. The method of claim 39, and further comprising the step of placing a grate on said frame members of each said device after said moldable trench composition has set.

44. The method of claim 39, and further comprising the step of placing additional weight on top of said form while said moldable trench composition is setting.

45. The method of claim 39, wherein each said trench forming device has a front end and a back end opposite said front end, said front end and said back end perpendicular to the longitudinal axis of each said device, and said trench forming device placing step comprises abutting said front end of a first device against a said back end of an adjacent device when said devices are placed in the ditch and adjacent to each other.

46. The method of claim 39, wherein said trench forming device placing step comprises placing said forms of each said device adjacent to each other when said devices are placed in the ditch and adjacent to each other.

47. The method of claim 46, wherein each said form of each said device has a front end and a back end opposite said front end, said front end and said back end perpendicular to the longitudinal axis of each said form, and said trench forming device placing step comprises abutting said front end of a first form against said back end of an adjacent form when said forms are placed adjacent to each other.

48. The method of claim 47, and further comprising the step of placing a means on said abutting forms for preventing said moldable trench composition from seeping between said abutting forms.

* * * * *